US012553114B2

(12) United States Patent
So et al.

(10) Patent No.: US 12,553,114 B2
(45) Date of Patent: Feb. 17, 2026

(54) HIGH STRENGTH STEEL PLATE HAVING EXCELLENT LOW TEMPERATURE IMPACT TOUGHNESS. AND METHOD FOR MANUFACTURING THE SAME

(71) Applicant: POSCO, Pohang-si (KR)

(72) Inventors: Tae-Il So, Gwangyang-si (KR); Sang-Deok Kang, Gwangyang-si (KR)

(73) Assignee: POSCO, Pohang-si (KR)

( * ) Notice: Subject to any disclaimer, the term of this patent is extended or adjusted under 35 U.S.C. 154(b) by 734 days.

(21) Appl. No.: 17/772,672

(22) PCT Filed: Oct. 26, 2020

(86) PCT No.: PCT/KR2020/014667
§ 371 (c)(1),
(2) Date: Apr. 28, 2022

(87) PCT Pub. No.: WO2021/091138
PCT Pub. Date: May 14, 2021

(65) Prior Publication Data

US 2022/0372603 A1 Nov. 24, 2022

(30) Foreign Application Priority Data

Nov. 4, 2019 (KR) ..... 10-2019-0139226

(51) Int. Cl.
*C22C 38/58* (2006.01)
*C21D 8/02* (2006.01)
(Continued)

(52) U.S. Cl.
CPC ..... *C22C 38/58* (2013.01); *C21D 8/0205* (2013.01); *C21D 8/0226* (2013.01);
(Continued)

(58) Field of Classification Search
CPC ..... C22C 38/58; C22C 38/001; C22C 38/02; C22C 38/06; C22C 38/44; C22C 38/48;
(Continued)

(56) References Cited

U.S. PATENT DOCUMENTS

2010/0263773 A1* 10/2010 Cho ..... C22C 38/12 148/330
2018/0073116 A1 3/2018 Zhao et al.

FOREIGN PATENT DOCUMENTS

CN 105624553 B 5/2017
CN 106995905 A 8/2017
(Continued)

OTHER PUBLICATIONS

KR-101736626-B1 Translation (Year: 2017).*
(Continued)

*Primary Examiner* — Danielle M. Carda
(74) *Attorney, Agent, or Firm* — Morgan Lewis & Bockius LLP

(57) ABSTRACT

Provided are high-strength steel plate having excellent low-temperature impact toughness and method of manufacturing the same. The present disclosure relates to a high-strength steel plate comprising, by weight %, carbon (C): 0.04-0.12%, silicon (Si): 0.1-0.5%, manganese (Mn): 1.2-2.5%, phosphorus (P): 0.01% or less, sulfur (S): 0.01% or less, aluminum (Al): 0.01-0.08%, niobium (Nb): 0.01-0.08%, chromium (Cr): 0.01-0.5%, nickel (Ni): 0.4-1.0%, copper (Cu): 0.5% or less, molybdenum (Mo): 0.01-0.5%, vanadium (V): 0.05% or less, titanium (Ti): 0.005-0.02%, boron (B): 0.001-0.0025%, nitrogen (N): 0.002-0.01%, the balance Fe and inevitable impurities, a Ceq value being less than 0.55.

5 Claims, 1 Drawing Sheet

(A)

(B)

(51) Int. Cl.

| | |
|---|---|
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C21D 8/0273* (2013.01); *C21D 9/46* (2013.01); *C22C 38/001* (2013.01); *C22C 38/02* (2013.01); *C22C 38/06* (2013.01); *C22C 38/44* (2013.01); *C22C 38/48* (2013.01); *C22C 38/50* (2013.01); *C22C 38/54* (2013.01); *C21D 2211/002* (2013.01); *C21D 2211/005* (2013.01)

(58) Field of Classification Search
CPC ..... C22C 38/50; C22C 38/54; C22C 38/04; C22C 38/46; C22C 38/42; C21D 8/0205; C21D 8/0226; C21D 8/0273; C21D 9/46; C21D 2211/002; C21D 2211/005; C21D 1/02; C21D 1/18; C21D 1/25; C21D 1/26; C21D 1/60; C21D 6/004; C21D 6/005; C21D 8/021; C21D 8/0263; C21D 1/63
USPC ..... 420/119
See application file for complete search history.

(56) References Cited

FOREIGN PATENT DOCUMENTS

| | | | | | |
|---|---|---|---|---|---|
| EP | 3395997 | A1 | | 10/2018 | |
| JP | 2018-512508 | A | | 5/2018 | |
| KR | 10-2009-0052950 | A | | 5/2009 | |
| KR | 10-2009-0066639 | A | | 6/2009 | |
| KR | 10-2009-0071182 | A | | 7/2009 | |
| KR | 10-2013-0002173 | A | | 1/2013 | |
| KR | 10-2013-0064760 | A | | 6/2013 | |
| KR | 10-1320222 | B1 | | 10/2013 | |
| KR | 10-1531361 | B1 | | 6/2015 | |
| KR | 10-2017-0054622 | A | | 5/2017 | |
| KR | 101736626 | B1 | * | 5/2017 | ..... C22C 38/58 |
| WO | 2018/117509 | A1 | | 6/2018 | |

OTHER PUBLICATIONS

European Search Report issued Jun. 6, 2023 for corresponding European Patent Application No. 20884059.5.
International Search Report dated Feb. 18, 2021 issued in International Patent Application No. PCT/KR2020/014667 (with English translation).

* cited by examiner (A)
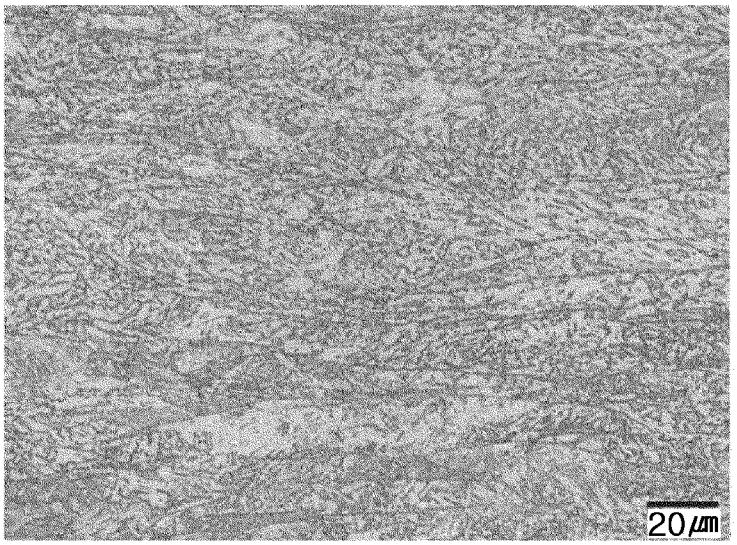
(B)
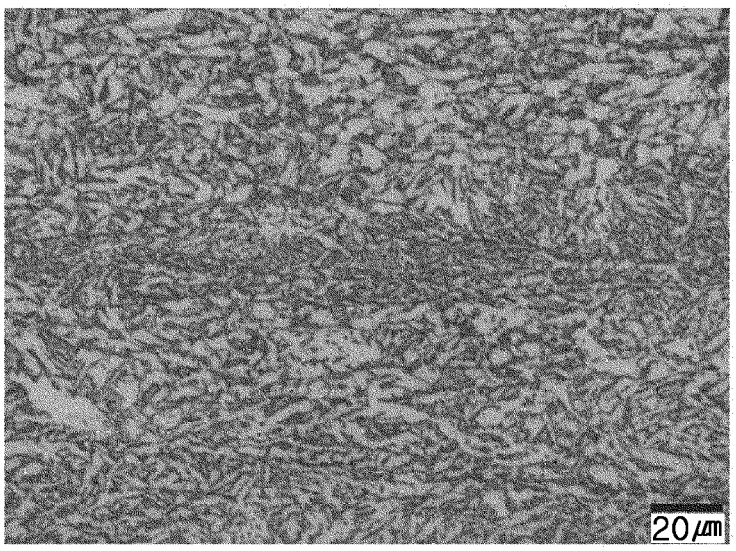

HIGH STRENGTH STEEL PLATE HAVING EXCELLENT LOW TEMPERATURE IMPACT TOUGHNESS. AND METHOD FOR MANUFACTURING THE SAME

CROSS-REFERENCE OF RELATED APPLICATIONS

This application is the U.S. National Phase under 35 U.S.C. § 371 of International Patent Application No. PCT/KR2020/014667, filed on Oct. 26, 2020, which in turn claims the benefit of Korean Application No. 10-2019-0139226, filed on Nov. 4, 2019, the entire disclosures of which applications are incorporated by reference herein.

TECHNICAL FIELD

The present invention relates to a high strength steel plate for construction or construction machinery having excellent low temperature impact toughness and a method for manufacturing the same.

BACKGROUND ART

Steel used for construction machinery requires high durability and strength, and in recent years, demand for thick wall steel plate has increased, depending on the enlargement in size of such construction machinery. In particular, steel used in large excavator buckets must guarantee not only strength but also durability due to long-term use, so that wear resistance characteristics thereof are very important. However, despite the excellent wear resistance, a bucket is entirely damaged when used for a long period of time, and accordingly, demand for high strength steel having excellent impact toughness is increasing.

Moreover, in recent years, as such large excavators are used even in arctic areas, demand for high-strength, thick-walled steel plate capable of guaranteeing impact toughness at the −20° C. level is also increasing to ensure long-term use.

On the other hand, in order to manufacture a high-strength steel plate, a method of improving strength by adding an appropriate amount of a hardening-increasing element such as Mn, Cr, and Mo, that is, method for improving strength by enhancing quenching properties, has been widely used. In such a case, a large amount of low-temperature microstructure such as bainitic ferrite is formed in the steel matrix through a cooling treatment, thereby improving steel strength and low-temperature impact toughness. However, when the hardening element is excessively added, it results in the formation of martensite due to the increase of carbon equivalent, so that it causes problems that the toughness is degraded, the preheating temperature before welding is increased, or cracks may occur.

An example is the invention described in Patent Document 1. Patent 1 describes a technique for fulfilling a high strength having excellent low temperature toughness, comprising of preparing slabs added with various components followed by reheating them so as to homogenize the same, hot rolling and accelerating cooling the homogenized steel slabs, and performing subsequent tempering heat treatment. In addition, the invention described in Patent 1 intends to obtain sufficient quenching properties by controlling a content ratio of nitrogen (N) and boron (B), and intends to improve toughness by controlling the content of titanium (Ti) to a very low level. However, the invention described in Patent 1 has a problem in that, when nitrogen content is not appropriately controlled so as to form excess nitrogen, surface cracks may occur through AlN formation or quenching properties by boron may not be sufficiently due to the BN formation.

PRIOR ART LITERATURE

Patent Literature (Patent Document 1) Korean Patent Publication KR10-1320222

SUMMARY OF INVENTION

Technical Problem

Therefore, an aspect of the present disclosure is to provide a high strength steel plate having excellent low-temperature impact toughness, and a method for manufacturing the same by optimizing components and roll conditions as a high-strength steel plate for construction machinery.

However, the problems to be solved by the present disclosure are not limited to the problems mentioned above, and other problems not mentioned will be clearly understood by those skilled in the art from the following descriptions.

Solution to Problem

According to an aspect of the present disclosure, a high-strength steel plate having low-temperature impact toughness comprises, by weight %, carbon (C): 0.04-0.12%, silicon (Si): 0.1-0.5%, manganese (Mn): 1.2-2.5%, phosphorus (P): 0.01% or less, sulfur(S): 0.01% or less, aluminum (Al): 0.01-0.08%, niobium (Nb): 0.01-0.08%, chromium (Cr): 0.01-0.5%, nickel (Ni): 0.4-1.0%, copper (Cu): 0.5% or less, molybdenum (Mo): 0.01-0.5%, vanadium (V): 0.05% or less, titanium (Ti): 0.005-0.02%, boron (B): 0.001-0.0025%, nitrogen (N): 0.002-0.01%, the balance Fe and inevitable impurities, a Ceq value represented by the following Relation 1 being less than 0.55, the steel plate has an internal microstructure comprising, in area fraction, 80% or more of bainitic ferrite and remaining granular bainite at a thickness of 1/4t of the steel plate.

the steel plate has a prior austenite having an aspect ratio of 3.0 or more, and the steel plate has a thickness of 60 mm or more and 100 mm or less.

$$C+6/Mn+Si/24+Cr/5+V/14+Ni/40+Mo/4 \quad \text{[Relational expression 1]}$$

In addition, the steel plate of the present disclosure may have a yield strength of 650 MPa or more, a tensile strength of 750 MPa or more, and a Charpy Impact Absorption Energy (CVN) value of 60 J or more at −20° C. at a thickness point of ¼t.

Moreover, according to another aspect of the present disclosure, a method of manufacturing a high-strength steel plate having low-temperature impact toughness comprises, reheating a steel slab having a composition, by wt %, carbon (C): 0.04-0.12%, silicon (Si): 0.1-0.5%, manganese (Mn): 1.2-2.5%, phosphorus (P): 0.01% or less, sulfur(S): 0.01% or less, aluminum (Al): 0.01-0.08%, niobium (Nb): 0.01-0.08%, chromium (Cr): 0.01-0.5%, nickel (Ni): 0.4-1.0%, copper (Cu): 0.5% or less, molybdenum (Mo): 0.01-0.5%, vanadium (V): 0.05% or less, titanium (Ti): 0.005-0.02%, boron (B): 0.001-0.0025%, nitrogen (N): 0.002-0.01%, the balance Fe and inevitable impurities, a Ceq value represented by the following Relational expression 1 being less than 0.55 in a temperature range of 1050~1200° C.;

rough rolling the reheated slab in a temperature of 1100~900° C.;

finish hot rolling the rough rolled bar in a temperature range between a finish hot rolling start temperature satisfying the following Relational expression 2 and Ar3 temperature based on the temperature measured by center portion of the bar, so as to manufacture a hot-rolled steel plate;

water-cooling the hot-rolled steel plate to 400° C. or less at a cooling rate of 2-10° C./s.

$$C+6/Mn+Si/24+Cr/5+V/14+Ni/40+Mo/4 \quad \text{[Relational expression 1]}$$

$$\text{Recrystallization stop temperature (RST)} - \text{Finish rolling start temperature } (^\circ\text{C.} > 100^\circ)\text{ C.} \quad \text{[Relational expression 2]}$$

Here, RST is 887+464C+6445Nb−644Nb0.5+732V−230V0.5−890Ti+363 Al−357Si (C, Nb, V, Ti, Al and Si are each by weight %).

Advantageous Effects of Invention

The present disclosure with the configuration as described above may provide a high strength steel plate having a yield strength of 650 MPa or more, a tensile strength of 760 MPa or more, and a Charpy impact Absorption energy evaluated in a longitudinal direction at −20° C. of at ¼t (t: thickness of steel plate, mm).

BRIEF DESCRIPTION OF DRAWINGS

FIG. 1 is a photograph exhibiting microstructures of Invention Example 3 and Comparative Example 15 according to an embodiment of the present invention at thickness 100 mm and ¼t points.

BEST MODE FOR INVENTION

Hereinafter, the present disclosure will be described.

The present inventors have recognized the need to develop a method for ensuring physical properties required for a material thereof as a bucket for a construction machine, particularly, an excavator, and have studied in depth on a method for ensuring high strength and excellent low-temperature impact toughness. As a result, it is confirmed that a thick wall steel plate having target physical properties may be provided by controlling a steel composition and a relationship between some components in an alloy design, and optimizing a manufacturing condition. The component to be proposed in the present disclosure is capable of forming the TiN by bonding nitrogen (N) and a sufficient amount of titanium (Ti), thereby obtaining a sufficient amount of free boron (B) to realize high strength.

From this point of view, the high strength steel having excellent low-temperature impact toughness according to this disclosure comprises, by weight %, carbon (C): 0.04-0.12%, silicon (Si): 0.1-0.5%, manganese (Mn): 1.2-2.5%, phosphorus (P): 0.01% or less, sulfur (S): 0.01% or less, aluminum (Al): 0.01-0.08%, niobium (Nb): 0.01-0.08%, chromium (Cr): 0.01-0.5%, nickel (Ni): 0.4-1.0%, copper (Cu): 0.5% or less, molybdenum (Mo): 0.01-0.5%, vanadium (V): 0.05% or less, titanium (Ti): 0.005-0.02%, boron (B): 0.001-0.0025%, nitrogen (N): 0.002-0.01%, the balance Fe and inevitable impurities, a Ceq value represented by the following Relational expression 1 being less than 0.55

Hereinafter, the reason for limiting the components of the steel plate will be described in detail. Meanwhile, unless specifically described in the present disclosure, the content of each element is based on the weight, and the fraction of microstructure is based on the area.

Carbon (C): 0.04-0.12%

C is the most effective element in improving strength by enhancing quenching properties of steel plate, and is desirably contained in 0.04% or more to sufficiently obtain the effect. However, when the content exceeds 0.12%, the required strength of the steel plate is too high and the low-temperature impact toughness of the base steel plate is significantly reduced, and thus the content C in the present disclosure is preferably 0.04 to 0.12%. More preferably, the C content is limited to 0.04 to 0.08%.

Silicon (Si): 0.1-0.5%

Si is used as a deoxidizer and is an effective element for strength improvement. However, if the addition amount exceeds 0.5%, low temperature toughness may decrease. On the other hand, when it is less than 0.1%, the deoxidation effect thereof may be insufficient. Therefore, it is preferable that the content of Si is 0.1 to 0.5%. It is more preferable that the Si content is limited to 0.1 to 0.3%.

Manganese (Mn): 1.2-2.5%

Mn is an element that is advantageous in ensuring strength along with C, and may be preferably added at least 1.2% to obtain such an effect. However, if the content exceeds 2.5%, segregation can be induced in the center, significantly inhibiting physical properties, so that it is desirable to add Mn in a content of 1.2 to 2.5%. More preferably, the Mn content is limited to 1.8 to 2.5%.

Phosphorus (P): 0.01% or Less

P is an element advantageous for strength improvement and corrosion resistance, but it is advantageous to maintain it as low as possible since it may significantly inhibit impact toughness, and thus the upper limit thereof is preferably 0.01%.

Sulfur (S): 0.01% or Less

Since S is an element that greatly degrades impact toughness by forming MnS or the like, it is advantageous to maintain it as low as possible, and thus it is desirable to set the upper limit of it to 0.01% or less.

Aluminum (Al): 0.01-0.08%

Al is an element capable of deoxidizing molten steel at a low cost, and is preferably contained in an amount of 0.01% or more in order to exhibit a sufficient effect. However, it is preferable that the content of Al is 0.01 to 0.08% because nozzle clogging may occur during continuous casting, when Al content exceeds 0.08%.

Niobium (Nb): 0.01-0.08%

Nb is dissolved in the matrix when reheating at a high temperature so as to suppress recrystallization of austenite, and transformation of ferrite or bainite, thereby fining the microstructure. In addition, it increases the stability of austenite even during cooling after hot rolling so that the formation of hard phases such as martensite and bainite even at low cooling rate is promoted, which is useful for securing base steel strength. However, when Nb is excessively added with Ti, coarse (Ti, Nb)(C,N) is formed during heating or after tempering heat treatment so as to degrade low-temperature impact toughness, and thus the content of Nb may be preferably limited to 0.01 to 0.08%. More preferably, the Nb content is limited to 0.01 to 0.05%.

Chrome (Cr): 0.01-0.5%

Cr is an effective element for increasing the hardenability to form a bainite as low-temperature phase and obtain strength, and is preferably contained in an amount of 0.01% or more to exhibit a sufficient effect. However, excessive addition of Cr may cause martensite formation and an increase in fraction, and thus low-temperature impact toughness may be significantly degraded, and thus, the upper limit thereof may be set to 0.5%. More preferably, the Cr content is limited to 0.01 to 0.3%.

Nickel (Ni): 0.4-1.0%

Ni is an element capable of simultaneously improving the strength of the base steel and the low temperature impact toughness, and is preferably contained in an amount of 0.4% or more to exhibit sufficient effects. However, since Ni is an expensive element, there is a problem that economic feasibility is greatly degraded when 1.0% or more is contained. Therefore, it is preferable that the content of Ni is limited to the range of 0.4 to 1.0%. More preferably, the Ni content is limited to 0.6 to 1.0%.

Copper (Cu): 0.5% or Less

Since Cu is an element that may minimize degradation of toughness of a base steel and increase strength. However, an excessive addition of Cu may increase a carbon equivalent to degrade weldability and significantly degrade surface quality of a product. Therefore, in consideration of this, it is preferable that the Cu content is limited to 0.5% or less in the present disclosure.

Molybdenum (Mo): 0.01-0.5%

Since Mo significantly improves hardenability to suppress formation of ferrite, induce formation of bainite, and significantly improve strength, it is necessary to add 0.01% or more in order to manufacture a high-strength steel. However, it is an expensive alloy element and increases the carbon equivalent by a large range, so that the welding efficiency can be reduced as the preheating temperature increases before welding, so it needs to be suppressed to a maximum of 0.5%. Therefore, in the present disclosure, it is preferable that the content of Mo is limited to a range of 0.01 to 0.5%. More preferably, the Mo content is limited to 0.01 to 0.3%.

Vanadium (V): 0.05% or Less

V is an element effective in improving strength, such as Cr, Mo, and the like, and is an element that may be selectively added to obtain high strength. However, it is an expensive alloy element and can increase the formation of a hard phase such as MA to degrade the low temperature impact toughness, so it is desirable to limit the V content to 0.05% or less.

Titanium (Ti): 0.005-0.02%

Ti is added simultaneously with N to form TiN, which has an effect of suppressing the grain growth during reheating, and thus it is desirable to add 0.005% or more. However, if it is added to more than 0.02%, coarse (Ti,Nb) (C,N) carbonitrides may be formed during a steel slab reheating or tempering heat treatment process, thereby degrading low temperature impact toughness. Therefore, it is preferable that the content of Ti in the present disclosure is limited to the range of 0.005 to 0.02%.

Boron (B): 0.001-0.0025%

B is a low-priced alloy element, is an element exhibiting a strong hardenability even when adding a small amount, and is advantageous in inducing formation of a low-temperature phase of bainite and ensuring strength, and thus may be preferably added at least 0.001%. However, when it exceeds 0.0025%, martensite formation is induced, and low-temperature impact toughness is significantly degraded. Therefore, in the present disclosure, it is preferable that the content of B is limited in the range of 0.001 to 0.0025%.

Nitrogen (N): 0.002-0.01%

N is an element that suppresses the formation of BN by forming TiN when simultaneously added with Ti. However, when added in a large amount, coarse TiN is formed to degrade low-temperature impact toughness, and thus the maximum amount thereof is preferably 100 ppm. However, since not only the N content control of less than 20 ppm increases the load of the steelmaking process but also is not sufficient to suppress grain growth, the lower limit of the N content is preferably 20 ppm.

The remaining components of this disclosure are iron (Fe). However, in a conventional manufacturing process, impurities that are not intended from a raw material or the surrounding environment may be inevitably mixed, and thus this may not be excluded. All of these impurities are not particularly mentioned herein because they may be known by any skilled in the art.

Also, it is preferable that the steel plate of the present disclosure having the above-described alloy composition may have a Ceq value represented by the following Relational expression 1 of less than 0.55.

$$C+6/Mn+Si/24+Cr/5+V/14+Ni/40+Mo/4 \quad \text{[Relational expression 1]}$$

The present disclosure is to ensure high strength and excellent low temperature impact toughness by appropriately controlling the content of elements, when adding a certain amount thereof, advantageous in enhancing strength and hardenability in order to ensure target strength. In particular, C, Mn, Si, Cr, V, Ni, Mo, and the like are added to the steel plate of the present disclosure, and when the content thereof is excessive, it leads to increase the carbon equivalent (Ceq), thereby resulting in the problems such as weaking the toughness due to the formation of martensite, an increase in pre-welding temperature before welding, or a formation of cracks. Therefore, it is preferable to add the content of the above-described elements to satisfy the relational expression 1.

Meanwhile, the steel plate of the present disclosure may have a microstructure comprising a bainitic ferrite phase as a main phase, and may comprise some granular bainite phases.

More specifically, the steel plate of the present disclosure may comprise a bainitic ferrite phase of 80% or more, by area fraction ratio %, at a point of ¼t of a thickness of the steel plate, and the remainder may comprise a granular bainite phase. In addition, it is preferable that the aspect ratio of the grain boundary of prior austenite is 3.0 or more. If the fraction on the bainitic ferrite is less than 80% and the aspect ratio of the grain boundary of the prior austenite is less than 3.0, a target level strength may not be secured and impact toughness may be degraded.

The steel plate of this disclosure is a high strength steel plate with a thickness of 60 mm or more and 100 mm or less, and the steel plate of this disclosure with the above-described alloy component and microstructure may have a yield strength of 650 MPa or more, a tensile strength of 750 MPa or more, and a value of CVN at −20° C. of 60 J or more at a thickness of ¼t, thereby ensuring a high strength and excellent low temperature impact toughness.

Next, a method of manufacturing a high-strength steel having excellent low-temperature impact toughness of the present disclosure will be described.

The method for manufacturing a high-strength steel plate of the present disclosure, comprises, reheating a steel slab having a above described composition in a temperature range of 1050~1200° C.; rough rolling the reheated slab in a temperature of 1100~900° C.; finish hot rolling the rough rolled bar in a temperature range between a finish hot rolling start temperature satisfying the following Relational expression 2 and Ar3 temperature based on the temperature measured by center portion of the bar, so as to manufacture a hot-rolled steel plate; and water-cooling the hot-rolled steel plate to 400° C. or less at a cooling rate of 2-10° C./s.

First, in the present disclosure, the steel slab satisfying the above-described alloy composition and relational equation 1 is reheated at 1050 to 1200° C. When the steel slab (continuous casting slab or forged slab) is reheated at more than 1200° C., low-temperature impact toughness may be worse after manufacturing the steel sheet due to coarsening of austenite crystal grains, and when heated at less than 1050° C., it is difficult to re-dissolve the carbonitrides formed in the slab, and thus physical properties may be greatly degraded.

Subsequently, in the present disclosure, the reheated slab is subjected to rough rolling at a temperature of 1100 to 900° C. If the rough rolling temperature is less than 900° C., there is a problem that the subsequent finish hot rolling temperature is too low to increase the rolling load, and if it exceeds 1100° C., the austenite crystal grains may be coarsened.

And, in the present disclosure, a hot rolled steel plate is manufactured by finish hot rolling the rough rolled bar in a temperature range between a finish hot rolling start temperature satisfying the following Relational expression 2 and Ar3 temperature, based on the temperature measured by center portion of the bar.

Recrystallization stop temperature (RST)−Finish rolling start temperature (° C.>100°) C. [Relational expression 2]

Here, RST is 887+464C+6445Nb−644Nb0.5+732V−230V0.5−890Ti+363Al−357Si (C, Nb, V, Ti, Al and Si are each by weight %)

The present disclosure has a feature that the finish hot rolling start temperature is determined in consideration of RST as shown in Relational Expression 2. Such a relational expression 2 has been derived as a result of research and experiments of the present inventors, and hot rolling under this condition greatly reduces the grain size so that it is very useful in improving low temperature impact toughness. When hot rolling is performed at the recrystallization stop temperature or more, crystal grains may not be a sufficiently small size due to recovery and grain growth, whereas when hot rolling is performed at the temperature of less than recrystallization stop temperature, fine crystal grains nucleated from the austenite grain may be obtained. In addition, according to the research results of this inventors, when finish hot rolling starts at a temperature or less lower than 100° C. more than recrystallization stop temperature and accelerated cooling is performed, it is confirmed of having an effect that a bainitic ferrite with anisotropy is formed so as to improve Charpy impact energy evaluated in the roll direction.

If the finish hot rolling temperature starts at a temperature of higher than the finish hot rolling start temperature defined in Relational expression 2, sufficient rolling force is not applied to the hot rolled steel plate so that elongated bainitic ferrite is not formed, thereby not securing sufficient low-temperature impact toughness, whereas when the finish hot rolling temperature is at Ar3 or less, it is difficult to perform the hot rolling so that quality defects such as surface crack and the like may occur.

In this case, the temperature of Ar3 in the present disclosure may be determined using, for example, the following relational expression 3.

$$Ar3=910-310C-80Mn-20Cu-55Ni-80Mo+119V+124Ti-18Nb+179A1$$

Subsequently, in the present disclosure, the hot rolled steel plate is water cooled to a temperature of 400° C. or less at a cooling rate of 2 to 10° C./s. When the hot-rolled steel plate manufactured according to the above is water-cooled to 400° C. or less, if the cooling rate is less than 2° C./s based on the steel plate thickness ¼t (t: a thickness of steel plate (mm)) point, it is difficult to secure strength due to an increase of the fraction of ferrite and granular bainite, and thus, it is preferable to control the cooling rate to 2° C./s or more. On the other hand, when the cooling rate exceeds 10° C./s, low-temperature impact toughness may be significantly reduced due to martensite formation.

And in this disclosure, a tempering process may be selectively carried out on the water-cooled steel plate for (1.6t+30) minutes [where t is the thickness (mm) of the steel plate] in the range of 500~700° C.

In selectively tempering heat treatment for the cooled hot rolled steel plate, when the cooled hot rolled steel plate is heat treated at less than 500° C., it is difficult to secure strength because of the difficulty in forming fine precipitates, and when the temperature exceeds 700° C., low temperature impact toughness is impaired by forming coarse precipitates. Therefore, it is preferable to perform a tempering-heat treatment on the cooled hot rolled steel plate for (1.6t+30) minutes [where t is the thickness (mm) of the steel plate] in the range of 500~700° C., and then perform air-cooling.

The steel plate manufactured by the tempering heat treatment may have an internal structure comprising, in area fraction, 80% or more of tempered bainite and 80% or more of remaining granular bainite, and in this case, it is preferable that the aspect ratio of prior austenite is 3.0 or more.

MODE FOR INVENTION

Hereinafter, the present disclosure will be described in detail through examples.

EXAMPLE

Table 1 shows the components and composition of steel slabs manufactured by continuous casting. The inventive steel 1-3 is a steel type satisfying the components and compositions described in the present invention, whereas the comparative steel 1-2 is a steel type deviating from the range of Ni among the components proposed in the present invention, and Comparative Example 3 is a steel type deviating from scope of the relational expression 1. And comparative steel 4 is steel type that the composition of Ni and Nb is outside the scope of the present invention.

TABLE 1

| | C | Si | Mn | P | S | Al | Nb | Cr | Ni | Cu | Mo | V | Ti | B | N | R* |
|---|---|---|---|---|---|---|---|---|---|---|---|---|---|---|---|---|
| IS1 | 0.05 | 0.15 | 2.15 | 0.008 | 0.002 | 0.03 | 0.04 | 0.02 | 0.8 | 0.2 | 0.15 | 0.040 | 0.017 | 0.0015 | 0.0035 | 0.479 |
| IS2 | 0.05 | 0.15 | 2.10 | 0.008 | 0.001 | 0.03 | 0.04 | 0.2 | 0.8 | 0.2 | 0.15 | 0.040 | 0.017 | 0.0015 | 0.0035 | 0.507 |
| IS3 | 0.05 | 0.17 | 2.12 | 0.004 | 0.001 | 0.03 | 0.04 | 0.09 | 0.9 | 0.2 | 0.25 | 0.005 | 0.015 | 0.0013 | 0.0043 | 0.515 |

TABLE 1-continued

| | C | Si | Mn | P | S | Al | Nb | Cr | Ni | Cu | Mo | V | Ti | B | N | R* |
|---|---|---|---|---|---|---|---|---|---|---|---|---|---|---|---|---|
| CS1 | 0.05 | 0.15 | 2.15 | 0.008 | 0.001 | 0.03 | 0.04 | 0.02 | 0.2 | 0.0 | 0.30 | 0.040 | 0.017 | 0.0015 | 0.0035 | 0.501 |
| CS2 | 0.07 | 0.15 | 2.15 | 0.008 | 0.001 | 0.03 | 0.04 | 0.02 | 0.2 | 0.0 | 0.30 | 0.040 | 0.017 | 0.0015 | 0.0035 | 0.521 |
| CS3 | 0.09 | 0.15 | 2.15 | 0.008 | 0.001 | 0.03 | 0.04 | 0.02 | 0.8 | 0.0 | 0.30 | 0.040 | 0.017 | 0.0015 | 0.0035 | 0.556 |
| CS4 | 0.07 | 0.15 | 2.15 | 0.008 | 0.001 | 0.03 | 0.00 | 0.02 | 0.2 | 0.0 | 0.30 | 0.040 | 0.017 | 0.0015 | 0.0035 | 0.521 |

*R*: Relational expression 1.
IS: Inventive Steel,
CS: Comparative Steel

A continuous casting slab having the components and compositions of Table 1 was prepared to a thickness of 300 mm in consideration of the reduction ratio to the final product using a continuous casting machine. Reheating, finishing hot rolling, acceleration cooling, and the like under the conditions shown in Table 2 below was carried out for the casting slab so as to prepare a steel plate. Meanwhile, the finish hot-rolled steel plate in Table 2 was water-cooled to 250~320° C. at a cooling rate of 2.8~8.1° C./s based on a thickness of ¼t of each steel plate according to the thickness of the steel shown in Table 2-3.

And after acceleration cooling, tempering heat treatment was performed on the Inventive Steel 1 for 1.6t+30 minutes (t: steel plate thickness, mm) at a temperature of 550° C. (Invention Example 4-6). In addition, for the Invention Steel 1, the cases not satisfying the relational expression 2 (Comparative Example 1-3) were made by changing the finish hot rolling start temperature.

Thereafter, microstructures were observed for each steel plate prepared using the manufacturing conditions of Table 2, and mechanical properties were evaluated.

The steel microstructure was observed with an optical microscope, and then bainitic ferrite, granular bainite, polygonal ferrite, and martensite were visually classified using EBSD equipment. In addition, after calculating the ratio of the major axis and the minor axis of each prior austenite through an optical microscope, an average value for each ratio calculated was deemed the aspect ratio thereof. Table 3 shows the type and area fraction of the phases, and the average aspect ratio of prior austenite by thickness for each steel thus prepared.

As shown in Table 3, it may be seen that in the case of Inventive Examples 1-12 using the Inventive Steel 1-3 and satisfying the manufacturing conditions of the present inven-

TABLE 2

| | | | Finish hot rolling | | | | | | | | |
|---|---|---|---|---|---|---|---|---|---|---|---|
| Classification | Thickness (mm) | Reheating temperature (° C.) | start temparature (° C.) | RST | Relational expression 2 | end temperature (° C.) | SCT (° C.) | FCT (° C.) | CR (° C./s) | Tempering temperature ° C.) | Remarks |
| IS1 | 60 | 1080 | 850 | 995 | 145 | 830 | 810 | 320 | 8.0 | | IE1 |
| | 80 | 1080 | 830 | | 165 | 820 | 810 | 300 | 3.2 | | IE2 |
| | 100 | 1080 | 800 | | 195 | 790 | 790 | 250 | 2.8 | | IE3 |
| | 60 | 1080 | 850 | | 145 | 830 | 810 | 320 | 8.0 | 550 | IE4 |
| | 80 | 1080 | 830 | | 165 | 820 | 810 | 300 | 3.2 | 550 | IE5 |
| | 100 | 1080 | 800 | | 195 | 790 | 790 | 250 | 2.8 | 550 | IE6 |
| | 60 | 112 | 920 | | 75 | 900 | 850 | 320 | 8.1 | | CE1 |
| | 80 | 1120 | 910 | | 85 | 890 | 840 | 300 | 3.3 | | CE2 |
| | 100 | 1120 | 900 | | 95 | 880 | 830 | 250 | 2.9 | | CE3 |
| IS2 | 60 | 1080 | 850 | 995 | 145 | 830 | 810 | 320 | 8.0 | | IE7 |
| | 80 | | 830 | | 165 | 820 | 810 | 300 | 3.2 | | IE8 |
| | 100 | | 800 | | 195 | 790 | 790 | 250 | 2.8 | | IE9 |
| IS3 | 60 | 1080 | 850 | 990 | 140 | 830 | 810 | 320 | 8.0 | | IE10 |
| | 80 | | 830 | | 160 | 820 | 810 | 300 | 3.2 | | IE11 |
| | 100 | | 800 | | 190 | 790 | 790 | 250 | 2.8 | | IE12 |
| CS1 | 60 | 1080 | 850 | 995 | 145 | 830 | 810 | 320 | 8.0 | | CE4 |
| | 80 | | 830 | | 165 | 820 | 810 | 300 | 3.2 | | CE5 |
| | 100 | | 800 | | 195 | 790 | 790 | 250 | 2.8 | | CE6 |
| CS2 | 60 | 1080 | 850 | 1004 | 154 | 830 | 810 | 320 | 8.0 | | CE7 |
| | 80 | | 830 | | 174 | 820 | 810 | 300 | 3.2 | | CE8 |
| | 100 | | 800 | | 204 | 790 | 790 | 250 | 2.8 | | CE9 |
| CS3 | 60 | 1080 | 850 | 1014 | 164 | 830 | 810 | 320 | 8.0 | | CE10 |
| | 80 | | 830 | | 184 | 820 | 810 | 300 | 3.2 | | CE11 |
| | 100 | | 800 | | 214 | 790 | 790 | 250 | 2.8 | | CE12 |
| CS4 | 60 | 108 | 850 | 875 | 25 | 830 | 810 | 320 | 8.0 | | CE13 |
| | 80 | | 830 | | 45 | 820 | 810 | 300 | 3.2 | | CE14 |
| | 100 | | 800 | | 75 | 790 | 790 | 250 | 2.8 | | CE15 |

*In Table 2, SCT means accelerated cooling start temperature, FCT means accelerated cooling end temperature, and CR means cooling rate.
IS: Inventive Steel,
CS: Comparative Steel
IE: Inventive Example
CE: Comparative Example tion, most of the microstructure formed is bainitic ferrite, and a small amount of granular bainite is formed as the thickness is increased.

On the other hand, in the case of Comparative Examples 4-9 of the Comparative Steel 1-2, it may be seen that as the thickness of the steel increases, the granular bainite fraction is increased along with the decrease of the bainitic ferrite fraction, and thus all of them are out of the range proposed in the present invention.

In Comparative Examples 10-12 of the Comparative Steel 3, martensite was formed due to high carbon content and Ceq so that they are out of the value proposed in the present invention, and in Comparative Examples 13-15 of the Comparative Steel 4, the fraction of polygonal ferrite was high and the aspect ratio was low, and thus, it could be seen that all of them deviate from the value proposed in this invention.

On the other hand, it may be seen that in Comparative Examples 4-6 in which the Inventive Steel 1 is used but the process conditions are not within the scope of the present invention, the composition or fraction of the microstructure satisfies the value proposed in the present invention, but the aspect ratio is low, and thus all of them deviate from the value proposed in this invention.

Meanwhile, FIG. 1 is a photograph showing a microstructure at a thickness of 100 mm and ¼ t of Inventive Example 3 and Comparative Example 15.

TABLE 3

| | | Microstructure | | | | | |
|---|---|---|---|---|---|---|---|
| | Thickness (mm) | Bainitic ferrite | Granular bainite | Polygonal ferrite | Martensite | Aspect ratio | Remarks |
| IS1 | 60 | 100 | | | | 5.1 | IE1 |
| | 80 | 100 | | | | 4.7 | IE2 |
| | 100 | 88 | 12 | | | 4.2 | IE3 |
| | 60 | 100 (Tempered) | | | | 5.1 | IE4 |
| | 80 | 100 (Tempered) | | | | 4.7 | IE5 |
| | 100 | 100 (Tempered) | | | | 4.2 | IE6 |
| | 60 | 100 | | | | 2.9 | CE1 |
| | 80 | 98 | 2 | | | 2.7 | CE2 |
| | 100 | 86 | 14 | | | 2.6 | CE3 |
| IS2 | 60 | 100 | | | | 6.2 | IE7 |
| | 80 | 89 | 11 | | | 6.4 | IE8 |
| | 100 | 100 | | | | 6.0 | IE9 |
| IS3 | 60 | 100 | | | | 7.5 | IE10 |
| | 80 | 100 | | | | 8.2 | IE11 |
| | 100 | 94 | 6 | | | 6.9 | IE12 |
| CS1 | 60 | 100 | | | | 4.7 | CE4 |
| | 80 | 86 | 14 | | | 5.5 | CE5 |
| | 100 | 78 | 22 | | | 5.1 | CE6 |
| CS2 | 60 | 89 | | | 11 | 4.7 | CE7 |
| | 80 | 84 | 16 | | | 4.5 | CE8 |
| | 100 | 75 | 25 | | | 4.4 | CE9 |
| CS3 | 60 | 77 | | | 23 | 4.6 | CE10 |
| | 80 | 93 | | | 7 | 4.5 | CE11 |
| | 100 | 98 | 2 | | | 4.6 | CE12 |
| CS4 | 60 | 63 | 24 | 13 | | 1.4 | CE13 |
| | 80 | 64 | 15 | 21 | | 1.3 | CE14 |
| | 100 | 58 | 6 | 36 | | 1.2 | CE15 |

IS: Inventive Steel,
CS: Comparative Steel
IE: Inventive Example
CE: Comparative Example On the other hand, for the hot-rolled steel plates having the microstructure of Table 3 and having manufacturing process of Table 1-2, the tensile properties were measured at ¼t and the impact toughness evaluated in the longitudinal direction were measured at −20° C., and the results are shown in Table 4 below. In the tensile characteristics, YP, TS, and El mean 0.2% off-set yield strength, tensile strength, and elongation respectively, and are the results of testing a test piece of JIS1 standard taken from specimen in a perpendicular direction to the rolling direction of the steel plate.

TABLE 4

| | | Tensile properties | | | Impact | |
|---|---|---|---|---|---|---|
| | Thickness (mm) | YP (MPa) | TS (MPa) | El (%) | toughness (−20° C.)(J) | Remarks |
| IS1 | 60 | 674 | 795 | 17 | 112 | IE1 |
| | 80 | 658 | 786 | 18 | 84 | IE2 |
| | 100 | 653 | 796 | 17 | 73 | IE3 |
| | 60 | 684 | 765 | 21 | 132 | IE4 |
| | 80 | 668 | 766 | 22 | 104 | IE5 |
| | 100 | 663 | 767 | 23 | 96 | IE6 |
| | 60 | 654 | 777 | 18 | 43 | CE1 |
| | 80 | 638 | 768 | 20 | 37 | CE2 |
| | 100 | 633 | 778 | 17 | 33 | CE3 |
| IS2 | 60 | 692 | 827 | 16 | 118 | IE7 |
| | 80 | 682 | 829 | 16 | 107 | IE8 |
| | 100 | 670 | 827 | 15 | 92 | IE9 |
| IS3 | 60 | 726 | 857 | 17 | 108 | IE10 |
| | 80 | 708 | 847 | 16 | 92 | IE11 |
| | 100 | 703 | 857 | 13 | 85 | IE12 |
| CS1 | 60 | 704 | 835 | 18 | 56 | CE4 |
| | 80 | 693 | 825 | 17 | 46 | CE5 |
| | 100 | 682 | 821 | 15 | 40 | CE6 |

TABLE 4-continued

| | Thickness (mm) | Tensile properties YP (MPa) | TS (MPa) | El (%) | Impact toughness (−20° C.)(J) | Remarks |
|---|---|---|---|---|---|---|
| CS2 | 60 | 719 | 857 | 16 | 59 | CE7 |
| | 80 | 708 | 857 | 14 | 47 | CE8 |
| | 100 | 697 | 843 | 12 | 33 | CE9 |
| CS3 | 60 | 755 | 901 | 11 | 39 | CE10 |
| | 80 | 743 | 902 | 9 | 32 | CE11 |
| | 100 | 732 | 901 | 6 | 24 | CE12 |
| CS4 | 60 | 629 | 753 | 13 | 81 | CE13 |
| | 80 | 618 | 747 | 14 | 63 | CE14 |
| | 100 | 617 | 736 | 12 | 49 | CE15 |

IS: Inventive Steel,
CS: Comparative Steel
IE: Inventive Example
CE: Comparative Example As shown in Table 4, it may be seen that the Inventive Examples 1-12 satisfy all the physical properties within the range proposed by the present invention.

On the other hand, in the case of Comparative Example 4-12, the tensile characteristics satisfy the range proposed in the present invention, but the average value of impact toughness at −20° C. does not satisfy the value proposed in the present invention. In Comparative Example 4-9, low impact toughness was exhibited due to a decrease in quenching properties resulted from a low Ni content. Comparative Examples 10-12 exhibit excellent yield strength and tensile strength due to high C content, but on the contrary, impact toughness exhibited very low values, and thus were out of the values proposed in the present invention.

In addition, Comparative Example 13-15 is for a steel type in which polygonal ferrite was formed due to low Nb and Ni contents, and both yield strength and tensile strength were out of the values proposed in the present invention, and impact toughness was also decreased as the thickness was increased, which was out of the values proposed in the present invention.

In addition, Comparative Example 1-3 is a steel type that satisfies the range of components of this invention but does not satisfy Relational Expression 2, and it can be confirmed that the yield strength and impact toughness fail to reach a target value.

The present disclosure is not limited to the above embodiments and examples, but it may be manufactured in various different forms, and those of ordinary skill in the art to which the present disclosure pertains will understand that it may be implemented in other specific forms without changing the technical spirit or essential features of the present disclosure. Therefore, it should be understood that the embodiments and examples described above are illustrative in all respects and not restrictive.

The invention claimed is:

1. A high-strength steel plate having low-temperature impact toughness comprises, by weight %, carbon (C): 0.04-0.12%, silicon (Si): 0.1-0.5%, manganese (Mn): 1.2-2.5%, phosphorus (P): 0.01% or less, sulfur(S): 0.01% or less, aluminum (Al): 0.01-0.08%, niobium (Nb): 0.01-0.08%, chromium (Cr): 0.01-0.5%, nickel (Ni): 0.4-1.0%, copper (Cu): 0.5% or less, molybdenum (Mo): 0.01-0.5%, vanadium (V): 0.05% or less, titanium (Ti): 0.005-0.02%, boron (B): 0.001-0.0025%, nitrogen (N): 0.002-0.01%, the balance Fe and inevitable impurities, a Ceq value represented by the following Relational expression 1 being less than 0.55, the steel plate has an internal microstructure comprising, in area fraction, 80% or more of bainitic ferrite and remaining granular bainite at a thickness of 1/4t of the steel plate, the steel plate has a prior austenite having an aspect ratio of 3.0 or more, the steel plate has a Charpy Impact Absorption Energy (CVN) value of 60J or more at −20° C. at a thickness point of 1/4t, and the steel plate has a thickness of 60 mm or more and 100 mm or less:

$$C+6/Mn+Si/24+Cr/5+V/14+Ni/40+Mo/4. \quad \text{[Relational expression 1]}$$

2. The high-strength steel plate having low-temperature impact toughness of claim 1, wherein the steel plate has a yield strength of 650 MPa or more and a tensile strength of 750 MPa or more.

3. A method of manufacturing the high-strength steel plate having low-temperature impact toughness of claim 1 comprises, reheating a steel slab having a composition comprising by wt %, carbon (C): 0.04-0.12%, silicon (Si): 0.1-0.5%, manganese (Mn): 1.2-2.5%, phosphorus (P): 0.01% or less, sulfur(S): 0.01% or less, aluminum (Al): 0.01-0.08%, niobium (Nb): 0.01-0.08%, chromium (Cr): 0.01-0.5%, nickel (Ni): 0.4-1.0%, copper (Cu): 0.5% or less, molybdenum (Mo): 0.01-0.5%, vanadium (V): 0.05% or less, titanium (Ti): 0.005-0.02%, boron (B): 0.001-0.0025%, nitrogen (N): 0.002-0.01%, the balance Fe and inevitable impurities, a Ceq value represented by the following Relational expression 1 being less than 0.55, in a temperature range of 1050~1200° C.;

rough rolling the reheated slab in a temperature of 1100~900° C.;

finish hot rolling a rough rolled bar in a temperature range between a finish hot rolling start temperature satisfying the following Relational expression 2 and Ar3 temperature based on the temperature measured by a center portion of the bar, so as to manufacture a hot-rolled steel plate;

water-cooling the hot-rolled steel plate to 400° C. or less at a cooling rate of 2-10° C./s $$C+Mn/6+Si/24+Cr/5+V/14+Ni/40+Mo/4 \quad \text{[Relational expression 1]}$$

$$\text{Recrystallization stop temperature (RST)} - \text{Finish rolling start temperature (° C.>100°) C.} \quad \text{[Relational expression 2]}$$

here, RST is $887+464C+6445Nb-644Nb^{0.5}+732V-230V^{0.5}-890Ti+363Al-357Si$, C, Nb, V, Ti, Al and Si are each by weight %.

4. The method of manufacturing the high-strength steel plate having low-temperature impact toughness of claim 3, the method further comprising maintaining the water-cooled hot rolled steel plate for (1.6 t+30) minutes [where t is the thickness (mm) of the steel plate] in the range of 500~700° C.

5. The method of manufacturing the high-strength steel plate having low-temperature impact toughness of claim 3, wherein the water-cooled steel plate has a yield strength of 650 MPa or more, a tensile strength of 750 MPa or more, and a Charpy Impact Absorption Energy (CVN) value of 60J or more at −20° C. at a thickness point of 1/4t.

* * * * *